United States Patent [19]

Munini

[11] 4,423,607

[45] Jan. 3, 1984

[54] WASH TUB OF PLASTICS MATERIAL FOR CLOTHES WASHING MACHINES

[75] Inventor: Dino Munini, Pordenone, Italy

[73] Assignee: Industrie Zanussi S.p.A., Pordenone, Italy

[21] Appl. No.: 281,203

[22] Filed: Jul. 6, 1981

[30] Foreign Application Priority Data

Jul. 3, 1980 [IT] Italy ..... 45722 A/80

[51] Int. Cl.[3] ..... D06F 23/02; D06F 37/04; D06F 37/22

[52] U.S. Cl. ..... 68/23.2; 68/140; 68/144; 220/72

[58] Field of Search ..... 68/23.2, 24, 58, 139, 68/140, 142, 143, 144, 145, 146; 210/364, 380.2, 380.3; 366/220, 233; 220/72; 74/573 R

[56] References Cited

U.S. PATENT DOCUMENTS

| | | | |
|---|---|---|---|
| 2,984,094 | 5/1961 | Belaieff | 68/23.2 |
| 3,045,887 | 7/1962 | Caine | 220/72 X |
| 3,869,883 | 3/1975 | Rotter | 68/140 X |
| 4,320,848 | 3/1982 | Dye et al. | 220/72 |

FOREIGN PATENT DOCUMENTS

| | | | |
|---|---|---|---|
| 518213 | 9/1953 | Belgium | 68/23.2 |
| 530359 | 7/1954 | Belgium | 68/58 |
| 2241328 | 2/1974 | Fed. Rep. of Germany . | |
| 1585866 | 2/1978 | Fed. Rep. of Germany . | |
| 1362919 | 4/1964 | France . | |
| 1513957 | 1/1968 | France . | |
| 162400 | 6/1973 | Italy . | |
| 2004305 | 3/1979 | United Kingdom | 68/23.2 |
| 1555746 | 11/1979 | United Kingdom . | |

*Primary Examiner*—Philip R. Coe

*Attorney, Agent, or Firm*—Wenderoth, Lind & Ponack

[57] ABSTRACT

A wash tub for a front loading clothes washing machine of domestic type is made in a single body, preferably by injection moulding of plastics material. The tub is provided with a cylindrical band having at least two portions of different diameter. In the area of the region where the band changes in diameter, an annular stiffening rib is provided having seats for locking the suspension members of the tub. The rear portion includes in one piece box-like housings, or at least a bracket, capable of being filled with counterweight material or fixed to added ballast masses, respectively.

6 Claims, 2 Drawing Figures

WASH TUB OF PLASTICS MATERIAL FOR CLOTHES WASHING MACHINES

BACKGROUND OF THE INVENTION

The present invention relates to a wash tub of plastics material capable of being used in a front loading clothes washing machine of domestic type.

As is known, a clothes washing machine of this type is provided with a wash tub which can contain a rotatable drum and the liquids which are required for the washing operations. The drum is supported by a shaft, in turn brought by a hub which is provided with bearings and fixed, through sealing gaskets, to the rear wall of the wash tub.

In order to reduce the difficulties and costs for manufacturing and servicing of metal tubs, several solutions have been provided for tubs made of plastics material.

For example, French Pat. No. 1362919 relates to an enbloc tub made of plastics material and including all the auxiliary members (bearings, connectors, etc). However, this tub is of the top loading type, which undergoes reduced dynamic stresses as the relevant drum is supported on both sides.

Further patents (e.g. British Pat. No. 1555746 and W. German Utility Model No. 7231098) disclose tubs wherein only a few members, those which undergo less mechanical and/or thermal stresses, are made of plastics material.

W. German Pat. No. 1585866 describes a washing machine having a tub which is made of plastics material but provided with a metal stiffening band to which all the support elements are connected.

Moreover, French Pat. No. 1513957 discloses a plastic wash tub which is sustained by a support frame connected with the drive and support elements and ensuring the necessary strength when the tub is in operation.

Finally, Italian Utility Model No. 162400 relates to a wash tub made of thermoplastic material and consisting of two half-shells which are fitted to each other by means of bolted flanges.

Other plastic wash tubs having thick walls are known which, however, do not satisfactorily overcome the technical problems arising when replacing metal with plastics. Basically, these problems are due to the considerable deformations occurring in plastics material when the tub is subjected to strong mechanical stresses, particularly when the wash drum is spin-drying, and high thermal changes, due to the different washing stages of the machine.

SUMMARY OF THE INVENTION

Accordingly, it is an object of the present invention to provide an enbloc plastic wash tub, preferably made by injection moulding, which embodies also all the auxiliary members such as bearings, connectors, water supply and discharge conduits, etc., the tub having a maximum of reliability, structural simplicity and strength.

This object is attained, according to the invention, in a wash tub of plastics material, for a front loading clothes washing machine of domestic type, made in a single body including a rear wall which embodies a hub wherein bearings are located for a shaft capable of supporting the wash drum, the body including also a cylindrical band which carries ballast masses and is provided with inlet and discharge apertures for the washing liquid, as well as with flanges for fixing thereto the drive members of the drum and the suspension members for the drum and tub assembly.

The tub is characterized in that the cylindrical band has at least one front and one rear portion of different diameter, that of minor diameter being adjacent to the rear wall, the outer surface of the band being provided, in the area of the region where the band changes in diameter, with an annular rib including transverse stiffening elements and seats for locking suspension members.

Furthermore, the rear wall of the tub is provided with radial ribs which are shaped so as to stand the dynamic and thermal stresses occurring during the washing operations.

BRIEF DESCRIPTION OF THE DRAWINGS

The invention will be further described by way of non-limiting example, with reference to the accompanying drawings in which.

DETAILED DESCRIPTION OF THE INVENTION

Figure 1:
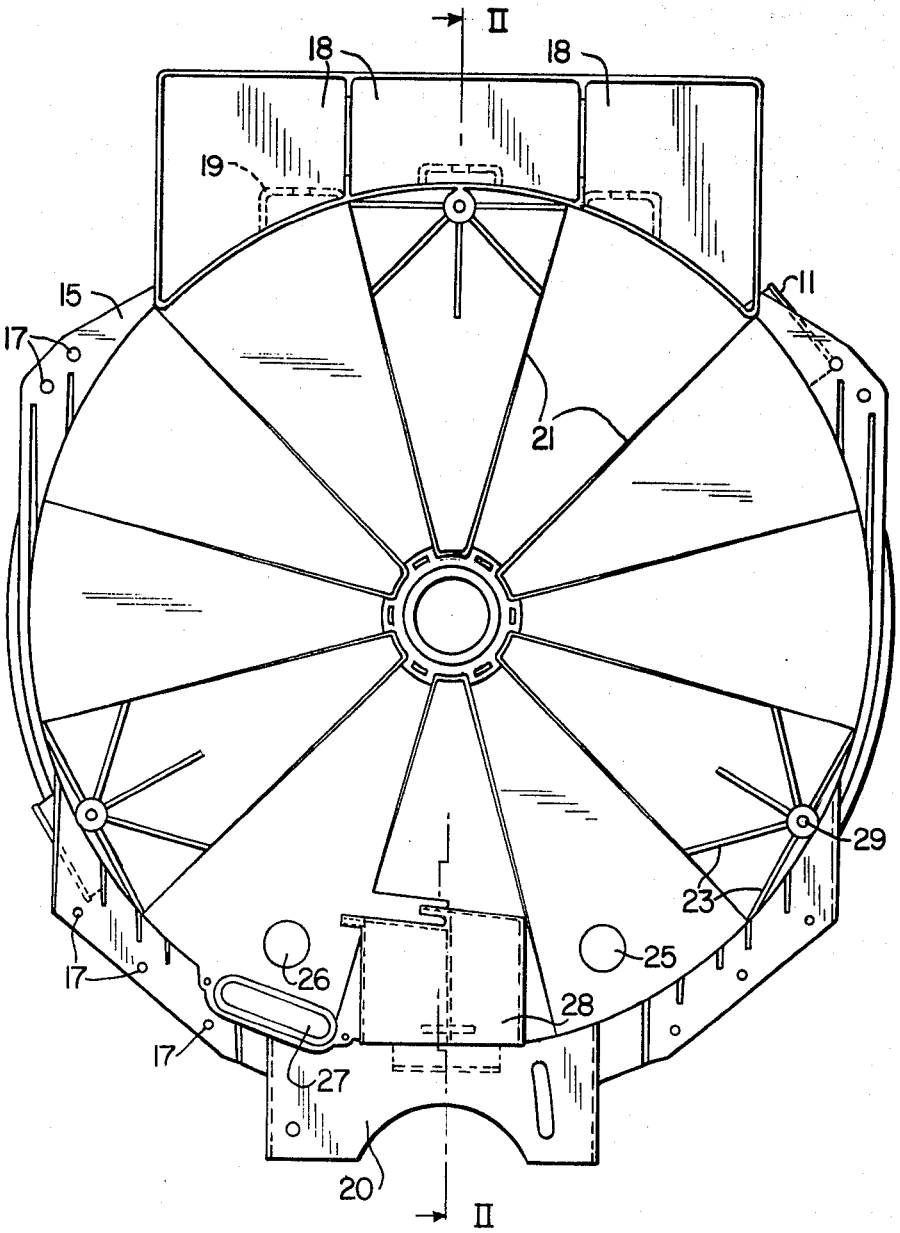
FIG. 1 is a diagrammatic rear view of a wash tub for a clothes washing machine according to the invention.
Figure 2:
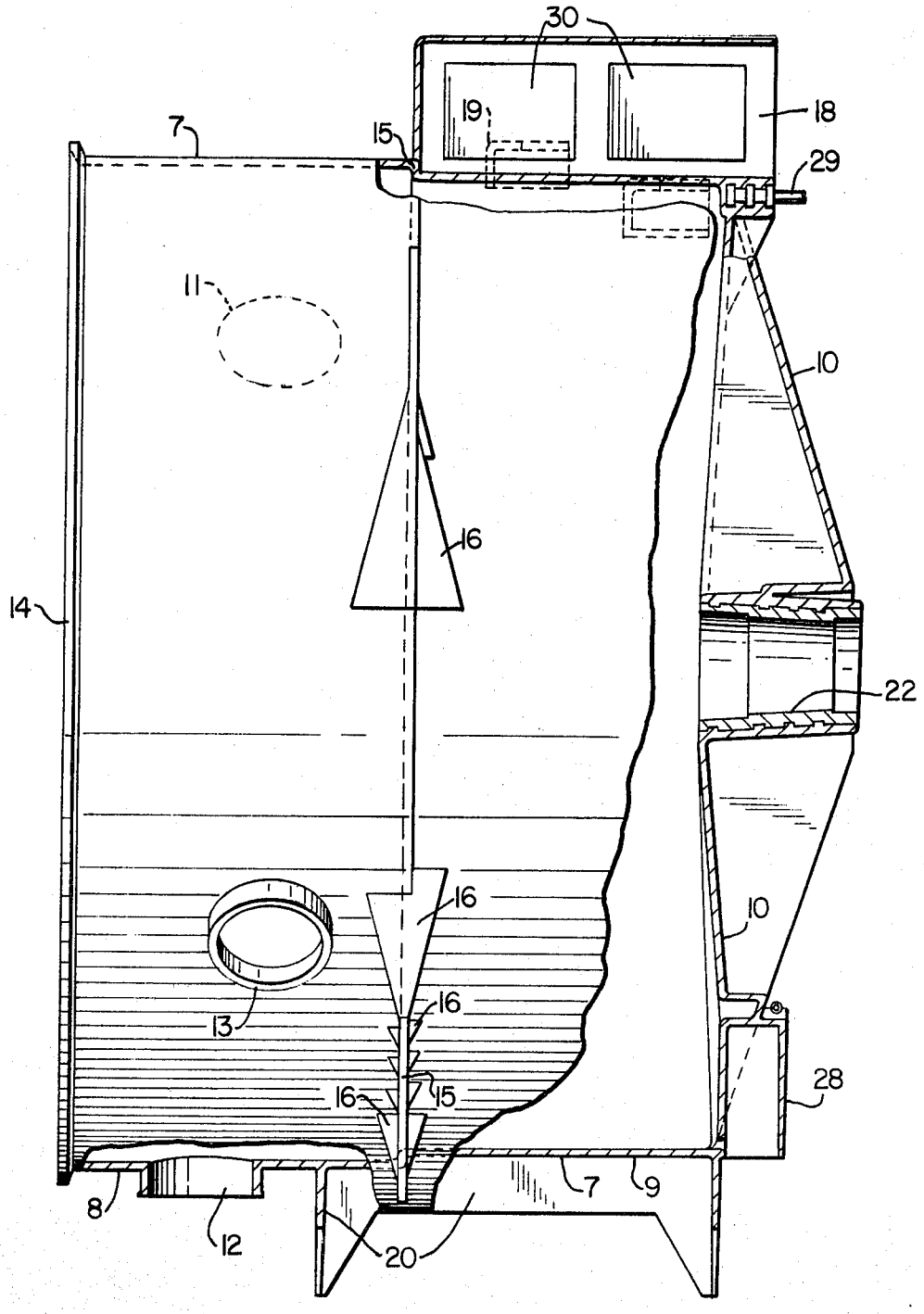
FIG. 2 is a diagrammatic side view of the tub of FIG. 1, partially sectioned along the line II—II.

With reference to the drawings, the wash tub according to the invention consists of a substantially cylindrical, single body preferably made by injection moulding of a proper thermoplastic material and comprising a cylindrical band or member 7, which in turn includes two portions 8 and 9 of different diameter, as well as a rear wall 10 which is integral with band 7. The front portion 8 has a diameter which is larger than that of the rear portion 9 and is provided with three circular apertures 11, 12, 13 which can respectively be connected to an inlet conduit and a discharge conduit for the washing liquid, as well as to a recirculating conduit which is provided for recovering the detergents that are collected at the bottom of the tub. The cylindrical portion 8 is provided with a front edge 14 projecting radially outwardly and capable of co-operating with a flange (not shown) which carries, in a way known per se, ballast masses, portion 8 defining also a front aperture for loading the clothes washing machine.

The rear portion 9 is adjacent to the rear wall 10 and is provided at the top with outer box-like housings 18 communicating with each other through passage holes 30 and capable of being filled with a counterweight material, e.g. concrete.

In another embodiment, the box-like housings may be replaced, with the same location on the rear portion 9, by at least one bracket 19 integral with the band 7 and to which added ballast masses can be fixed.

In the area of the region where the band changes in diameter, an annual rib 15 is provided having transverse stiffening tongues 16 and seats 17 for locking thereto the suspension and support members of the drum and tub assembly. In this way, the annular rib 15 and the relevant transverse stiffening tongues 16 can withstand all the dynamic stresses which are produced by the rotation of the drum and therefore make it possible to obtain a simpler construction of the tub, which further may be made with thinner walls.

The bottom side of the rear portion 9 is integral with a flange 20 including seats for locking and supporting the electric motor of the machine.

The rear wall 10 of the wash tub has a configuration including generally radial ribs 21 which are so arranged and shaped as to form a type of circular fret pattern around the perimeter of the wall 10. Thus, as shown in the drawings, the wall 10 and ribs 21 define segments which alternatively recessed. This feature enables the whole structure of the tub to gradually and evenly exchange heat, preventing in this way any deformation due to thermal changes during the different washing cycles.

At the center of the rear wall 10 is fitted a metal hub 22 for the bearings of the drum shaft.

Furthermore, the bottom side of the rear wall 10 is provided with apertures 25, 26 for inserting thermostatic switches capable of sensing the temperature of the washing liquid, and is also provided with a box-like housing 28 which is divided into two compartments forming relevant air-traps for corresponding pressure-switches (not shown) capable of monitoring the liquid level in the wash tub.

In the same region of the tub an integral housing 27 for the heating elements of the washing liquid is also provided, which housing radially projects outwards from the band. This projection enables a heating resistance (not shown), due also to the fact that the front portion 8 of the cylindrical band 7 has a larger diameter, to be located in a well defined area and completely submerged even with a minimum water level in the tub. This feature results in a reduction of electric energy consumption during operation.

Adjacent to its perimeter, the rear wall 10 of the tub has therein a plurality of outwardly projecting metal pins 29 the projecting ends of which are threaded and capable of co-operating with locking means for fixing the tub to the casing of the machine, during transportation thereof, in order to keep the tub steady.

Around the pins 29, the tub is provided with integral radial stiffening tongues or members 23 that, like the transverse tongues 16 of the annular rib 15, serve the function of distributing stresses onto surfaces of the tub (in the example given, those of the rear wall 10) which are as large as possible.

The main advantages of the wash tub according to the invention may be summarized as follows:

simplified and rationalized manufacture;

reduction of operations required for assembling the various components onto the tub;

improved strength of the tub against thermal and mechanical stresses.

I claim:

1. A wash tub for use with a domestic clothes washing machine of the front loading type, said wash tub comprising a single and integral body formed of plastic material, said body comprising:

a cylindrical member including a front cylindrical portion and a rear cylindrical portion having a diameter smaller than that of said front cylindrical portion, said cylindrical member including means for supporting ballast masses and means for supporting a drive member for a wash drum of a clothes washing machine, and said cylindrical member having therein inlet and discharge apertures for a washing liquid;

a rear wall integral with said rear cylindrical portion and closing a rear end of said cylindrical member, said rear wall including an integral hub for housing bearings for supporting a shaft of the wash drum; and said cylindrical member having extending outwardly therefrom, at an area of juncture between said front and rear cylindrical portions, an integral annular rib having integral transversely extending stiffening elements and including seats for locking attachment to suspension members to be used for suspending an assembly of said wash tub and the wash drum.

2. A wash tub as claimed in claim 1, further comprising an outwardly extending annular flange integral with the front end of said cylindrical member, and said front defining a front loading aperture.

3. A wash tub as claimed in claim 1, further comprising box-like housings integral with and extending outwardly from the top of said rear cylindrical portion, said housing being in communication through passage holes, and said housings being capable of being filled with a counterweight material.

4. A wash tub as claimed in claim 1, further comprising at least one bracket integral with and extending outwardly from said rear cylindrical portion and capable of supporting an added ballast mass.

5. A wash tub as claimed in claim 1, further comprising a plurality of metal pins projecting outwardly from said rear wall, outer ends of said pins being threaded for cooperation with locking devices for fixing said wash tub to a casing of the machine, and said rear wall including integral stiffening members extending generally radially from each said metal pin.

6. A wash tub as claimed in claim 1, further comprising a plurality of generally radially extending ribs integral with said rear wall and defining therewith a plurality of circumferentially spaced segments, circumferentially alternate of said segments being recessed inwardly.

* * * * *